United States Patent [19]

Guardiani

[11] Patent Number: 4,485,598

[45] Date of Patent: Dec. 4, 1984

[54] PREFABRICATED ELEMENTS AND ROOMS FOR THE QUICK CONSTRUCTION OF BUILDINGS AND BUILDING WORKS IN GENERAL

[76] Inventor: Eustachio Guardiani, Via della Corte, 6, 65100-Tocco Casauria (Pescara), Italy

[21] Appl. No.: 395,440

[22] Filed: Jul. 6, 1982

Related U.S. Application Data

[63] Continuation of Ser. No. 118,675, Feb. 5, 1980, abandoned.

[30] Foreign Application Priority Data

Feb. 5, 1979 [IT] Italy ..... 44205 A/79

[51] Int. Cl.[3] ..... E04H 1/00

[52] U.S. Cl. ..... 52/79.1; 52/169.9; 52/251; 52/259; 52/299; 52/742

[58] Field of Search ..... 52/79.1, 169.9, 721, 52/299, 79.12, 79.13, 251, 259, 293, 236.3, 742; 46/27, 28

[56] References Cited

U.S. PATENT DOCUMENTS

| | | | |
|---|---|---|---|
| 2,129,211 | 9/1938 | Hichl | 52/299 X |
| 2,287,229 | 6/1942 | Carpenter | 52/299 X |
| 3,292,329 | 12/1966 | Garancsy | 52/299 X |
| 4,107,889 | 8/1978 | Gonsalues | 52/299 X |
| 4,125,972 | 11/1978 | Pate | 52/79.12 |
| 4,207,714 | 6/1980 | Mehls | 52/79.1 X |

*Primary Examiner*—Carl D. Friedman

*Attorney, Agent, or Firm*—Beveridge, DeGrandi & Kline

[57] ABSTRACT

Prefabricated elements for a quick assembling of buildings and building works in general. Said elements are realized in the form of plinths, beams, rooms, staircases, roofs, floors and panels provided with a base by means of which said panel result to be independent for what concerns the stability, all of said elements being provided with a particular shape and with particular means so as to allow the assembling for the construction of a building of one or more floors, whereby the stability of said building is guaranteed, according to the different cases, by the own weight of the elements and/or by reinforcing means realized during the assembly.

10 Claims, 19 Drawing Figures

FIG.1
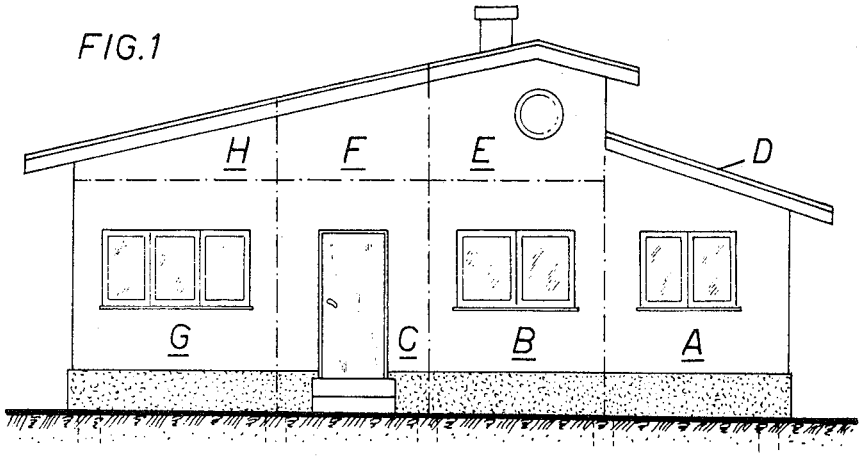
FIG.2
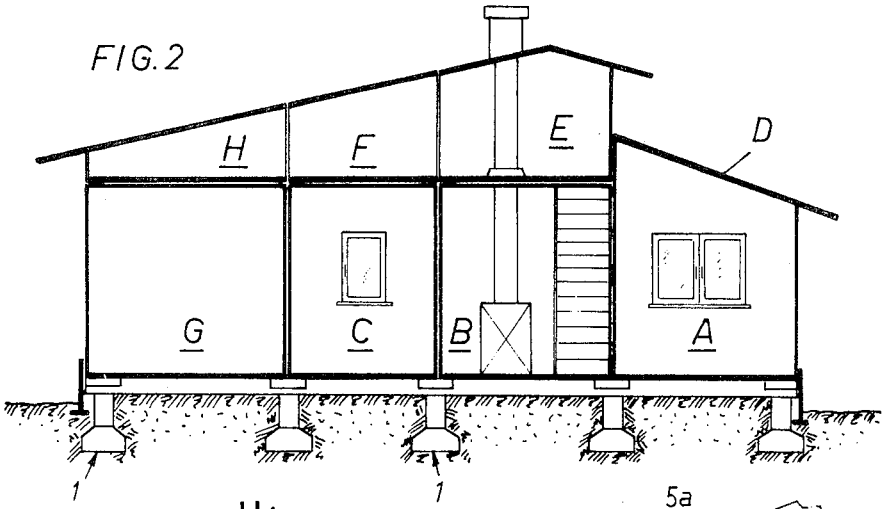
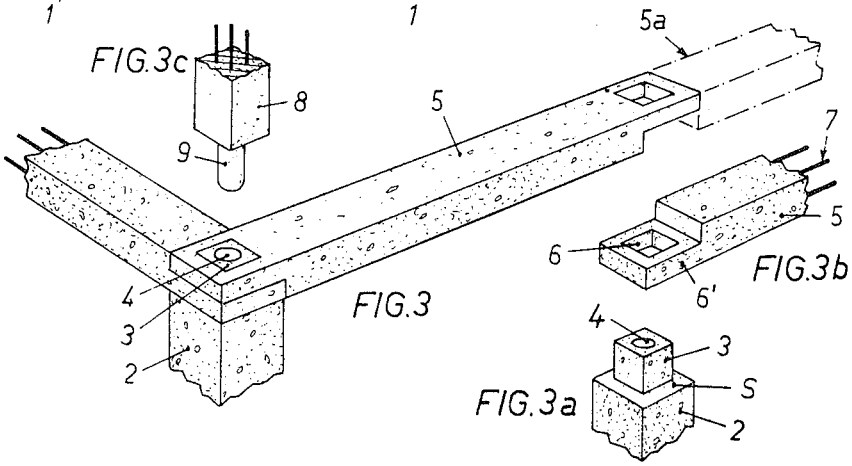

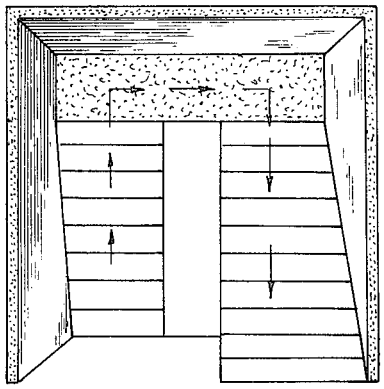
FIG.8
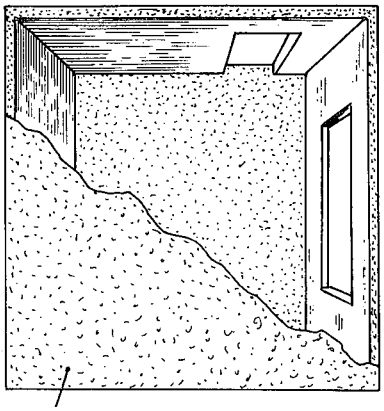
FIG.9
FIG.14
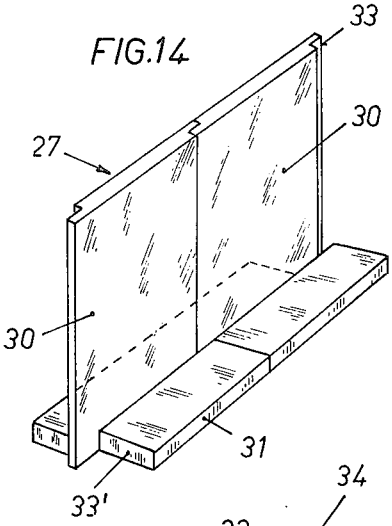
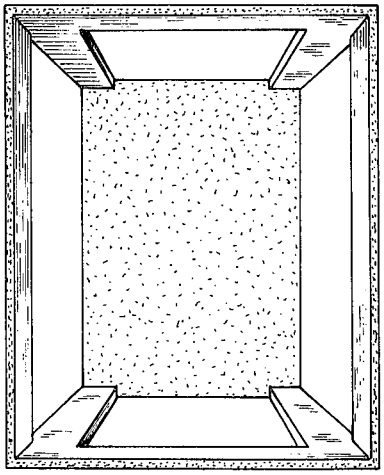
FIG.10
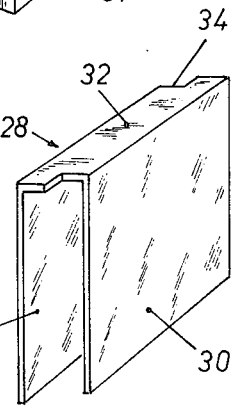
FIG.15
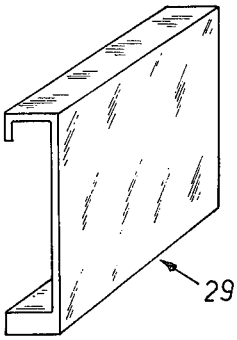
FIG.16

FIG.11
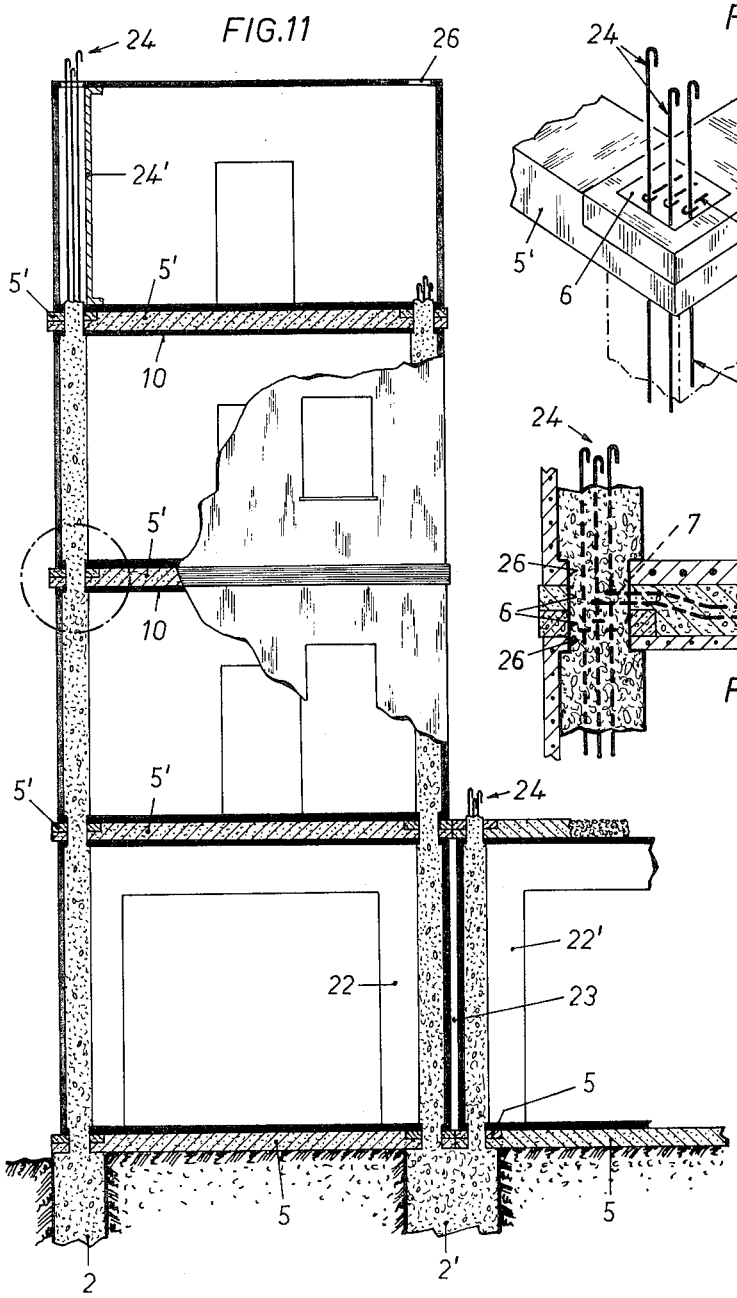
FIG.12
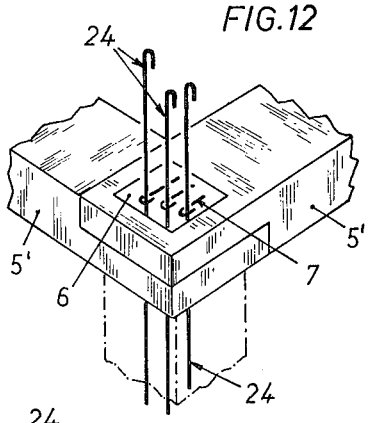
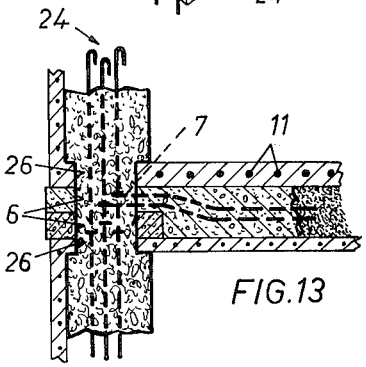
FIG.13

PREFABRICATED ELEMENTS AND ROOMS FOR THE QUICK CONSTRUCTION OF BUILDINGS AND BUILDING WORKS IN GENERAL

This application is a continuation, of application Ser. No. 6/118,675, filed Feb. 5, 1980, now abandoned.

The present invention concerns prefabricated elements and rooms for the quick construction of building and building works in general.

Prefabricated elements of various and different structure are already known for the construction of buildings, mainly of one floor, or in any case limited in the height thereof, whereby the assembling of those elements allows not only a quick and economic realization of a building, but also, eventually, an easy dismounting and transporting for moving the building in another zone. Those elements are requested for different reasons, not for the last, in some cases, for economical reasons, which however rarely bring along an esthetic diversification of the building. In most of the cases, however, said elements are requested in emergency cases, when it is absolutely indispensable to quickly build up the building following to natural catastrophes like earth-quakes, floods, landslips, etc. Also in this case the building has a temporary feature, mainly for what concerns the functional and esthetic factor, resenting from the structure of the assembling elements, from the deficiency, or even from the lacking of any esthetic element of the whole as well as, not for the last, from the limit in height of the building, which brings along the necessity of exploiting a greater surface with a consequent dissemination of a greater number of builidng unities.

It is therefore the aim of the present invention to realize prefabricated elements for the construction of buildings and similar, which allow a much quicker and functional assembling, therefore less expensive, also in consideration of the time needed for the assembling, whereby in this case the possibility is given to develop the building in height with a greater stability than the one obtained with the prefabricated elements of the known kind, but equal to the stability of the buildings of conventional kind, casted in loco, therefore with a saving of the surface and not for the last, full liberty to the designer to move within large limits for what concerns the esthetic aspect, still maintaining the concept of a series modular structure according to the different wishes of the various users.

The aim reached by the present invention, realizing prefabricated elements in the form of plinths, rooms or fractions of rooms with the function of living or working rooms, or staircases, roofs, pillars and self-supporting panels, all provided with particular shapes and means so as to provide an assembly in one or two floors, whereby the stability of the building is due, according to the cases, to the weight of said elements and/or also to reinforcing elements out of reinforced concrete, realized in the assembling stage.

According to the present invention, the most quick and simple realization is obtained in the case of a building which is limited in the height thereof, there where the stability of the whole may be relied upon the real weight of the single elements. In such a case it will be sufficient to provide such an excavation as to place therein the prefabricated plinths according to the present invention, and then to assemble all the other prefabricated elements according to the present invention, as it will be hereinbelow explained in detail.

The prefabricated plinths according to the present invention, which are to be placed at the ends of the building, show a lower part of conventional shape. Upon said base, a projecting trunk is provided e.g. of quadrangular shape showing, out of one piece, upperly, a part of a trunk of the same shape of the lower trunk, but of a smaller section. This part shows at the centre thereof a dead hole. The plinths which are to be placed between the ends of the building have a greater surface. From the lower part thereof, being of conventional shape, two trunks are projecting of the same shape than the ones before described, for the coupling of the adjacent rooms. All the plinths thus provided will be hooked by means of beams according to the present invention, which will be described in detail hereinbelow.

The prefabricated beams according to the present invention are out of reinforced concrete or, according to the cases, also out of any other material, as e.g. wood or mixed materials which show, at each end thereof, an offset part, provided with an opening of the same shape and dimension that the ones of that trunk of the plinth with the narrower section. The offset ends of two following beams, placed aligned or at an angle, will be superposed in a symmetric opposition of the relative offsets, and thus coupled on that part of the trunk with the narrower section. Said beams will also find a rest onto the horizontal surface of that trunk of the plinth with the bigger section, serving as a stop. Thus a real framework is realized by the beams which are supported by the plinths. The basement of the building is realized at a determined distance from the ground, thus guaranteeing a good isolation.

Onto said framework, out of crossed beams as before described, the prefabricated elements in the form of rooms, with the function of living or working rooms, are resting, and onto said prefabricated elements other elements will be placed with the function of a roof or a roof-mansard. Also these elements can be realized out of reinforced concrete, with a metallic network provided in it or, according to the cases, out of different material. Said elements can be provided, along the apex' of the vertical corners thereof, with pillars provided with a reduced section, out of one piece with the walls. Said incorporated pillars show, at the lower end thereof, a projection in the form of a joint, of a smaller section than the one of the pillar, and with a shape and a dimension corresponding to shape and dimension of the dead holes provided in the trunk of the plinths, so as to be inserted therein. At the other end thereof, said pillars show a dead hole within which the joint of the floor to be superposed will enter. The function of these pillars with a reduced section, out of one piece with the walls, is only the one to better hook the lower floor to the upper floor. The prefabricated elements in the form of rooms with the function of living or working rooms, or of a roof-mansard, are provided with this kind of pillar only if said elements are used for buildings of a limited height. The weight of the single prefabricated superposed elements and the relative joints and couplings will guarantee the stability of the whole.

Always according to the present invention, the building hereinbefore described can be raised with the same process, also applying esthetic variants to a second floor like, e.g., the addition of one or two balconies, or also of some terraces, always using prefabricated elements according to the present invention. In this case, also the rooms which are to be superposed to the first floor can be provided, in correspondence with the apex' of the relative vertical corners, with pillars of the kind before described, showing at the lower end joints to be inserted in the corresponding dead holes of the lower floors and showing, at the upper end, dead holes for receiving the joints of the room which is to be superposed. It is understood that the disposition of the joints and the dead holes can be inverted, i.e. the joints can be provided on the lower part and the dead holes on the upper part. The adjacent walls of the single rooms may be connected by means of brackets or cramps for a greater stability. For what concerns the addition of eventual terraces, said terraces can be realized by using plinths according to the present invention, as hereinbefore described, with pillars of the kind of the ones incorporated in the rooms, of the kind before described and a floor which, as hereinbefore said, may show apertures or joints at the apex' thereof for the joint onto said pillars. Also said pillars, in the embodiment described, can be realized out of reinforced concrete or out of any different material, according to the different cases. As it has already been said, the stability of the building can be, according to the cases, relied upon the sole resting of superposed rooms, or can be better guaranteed using incorporated pillars as well as the joints relative to the upper and lower rooms.

According to the present invention, the elements in the form of rooms with the function of living or working rooms, or of a staircase, of a roof, may form, according to the different cases, complete rooms or one or more parts of a room. The walls, or parts of walls, are generally out of concrete provided with a metallic network, but can also be realized, according to the cases, out of any different material. The floor, out of one piece with the room, is realized out of crossed reinforced-concrete rods which, in the case of parts of a room, are hooked between one part and the other of the same room, whereby the spaces are filled out with concrete. The stability of the floor naturally remains in greatest part relied upon the walls which, forming a single part with said floor, are placed at the sides thereof. The walls of the rooms or parts of the rooms, can be provided with apertures like doors, windows, arches, etc.

According to the present invention, in the case of a building of a greater height, i.e. with a greater number of floors, it is necessary to connect with a greater efficiency the elements of the structure. The basements will be equally realized with the prefabricated plinths according to the present invention. The plinths will be hooked between themselves by means of the prefabricated beams, according to the present invention. In this embodiment the prefabricated plinths will show, upperly with respect to the base thereof, a projection of quadrangular section from which the iron of the reinforcement thereof will project. Also from the ends of the prefabricated beams the iron of the reinforcement of the beam will project, towards the inside of the joint aperture, being of the same shape and dimension than the prolongation of the plinth. The irons of the beam will be hooked with the irons of the plinth. The room, or the part of the room, will show, at the apex of the vertical corners, an aperture in the floor of a shape and dimension equal to the aperture provided at the ends of the beams pitched onto the underposed plinth, from which aperture will upwardly project the irons of the reinforcement of the plinth. The room, or the part of the room, at the apex of the vertical corners whereof said apertures are performed, is now resting on the underposed framework out of the beams so that the irons of the reinforcement of the plinth pass through said aperture in the floor. The same operation takes place at the same time at the other apex' of the corners of the room, or part of the room, so that from the floor of said room the irons of the reinforcements of the underposed plinths will project. After having leaned in this way the room onto the beam framework, the irons are vertically prolonged until said irons surpass the height of said room so that said irons project beyond said room of a determined section. Around the such prolonged irons at the apex' of the rooms, the forms for base of pillar will be placed and the casting of concrete will be performed so as to realize reinforced-concrete pillars of the conventional kind.

As to realize the upper floor, prefabricated beams according to the present invention will be prepared, whereby the projecting irons will pass through the apertures of the offset ends thereof and will be resting onto the before casted pillars. Now the irons of the beams will be hooked to the irons of the pillars and the upper room will be superposed as has been hereinbefore described. The irons will be prolonged until the immediately upper floor so as to make the same project of a determined section beyond the height of the same, and the relative forms for base of pillars will be prepared performing then the reinforced-concrete casting.

It is thus possible to limit the reinforcements and the castings of concrete in the yard to the sole pillars of the puilding, while any other part of the same can be mounted in the form of a prefabricated element.

A further prefabricated element provided by the present invention is realized in the form of a self-supporting panel. One of the possible embodiments of the present invention consists in a vertical panel out of one piece with a horizontal base, so that the panel can be supported by the own weight thereof. The vertical part as well as the base of each panel laterally shows offsets which allow to connect between the same the various panels, thus confering stability to the whole. Another embodiment of the self-supporting panel consists in two vertical panels connected by a horizontal plane. Also in this case the panel will be supported by the own weight thereof. Along the sides of the panel offsets are provided for the connection of a plurality of panels. A further embodiment provides a vertical panel inclined at the upper and lower part thereof so as to form, at 90° with the vertical panel, an upper floor and a base. Thus, the panels may all keep the erected position thereof due to the own weight thereof and are therefore particularly suited for being used for the construction of sheds and swimming-pools, partitions or enclosures. Said panels allow to change the position thereof in any moment and to realize in any way and very quickly e.g. rooms like offices or magazins.

The advantages obtained by means of the present invention therefore consist essentially in the possibility of quickly realizing any building, also of a plurality of floors, using only prefabricated elements, and thus allowing, consequently, a considerable saving in labour and in occupied surfaces. It is thus furthermore allowed to every designer to choose according to his taste the esthetic of the building still respecting the modular technique of the structures.

The object of the present invention will be described now relating to some possible embodiments shown in the enclosed drawings, for exemplifying and not limitative purpose. In the drawings, the figures show:

FIG. 1, shows a perspective view of a one-floor building, realized with prefabricated elements according to the present invention in the form of plinths, beams, rooms and roof;

FIG. 2, shows a vertical section of the building of FIG. 1, the front being cut away;

Figure 4:
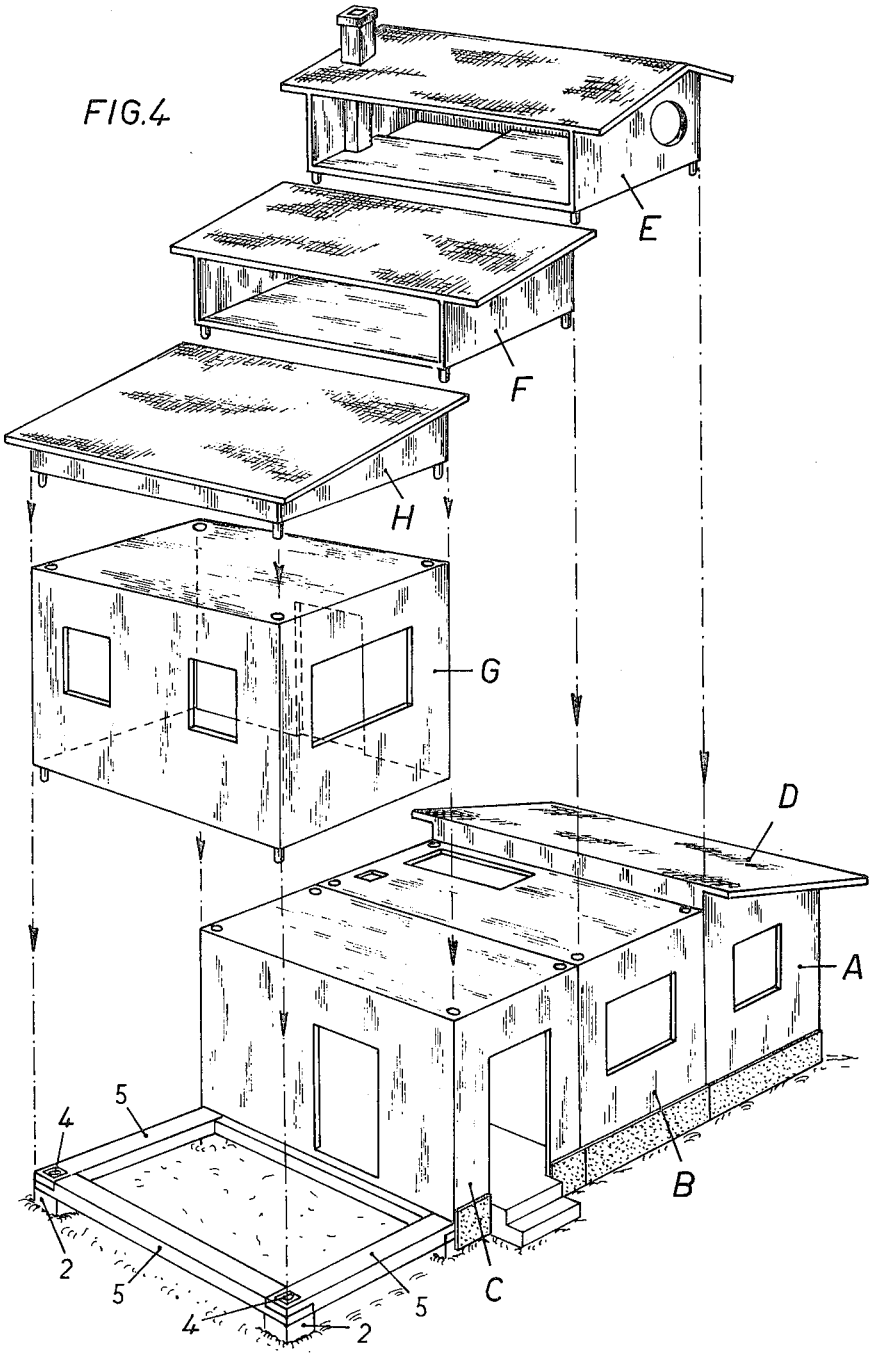
Figure 5:
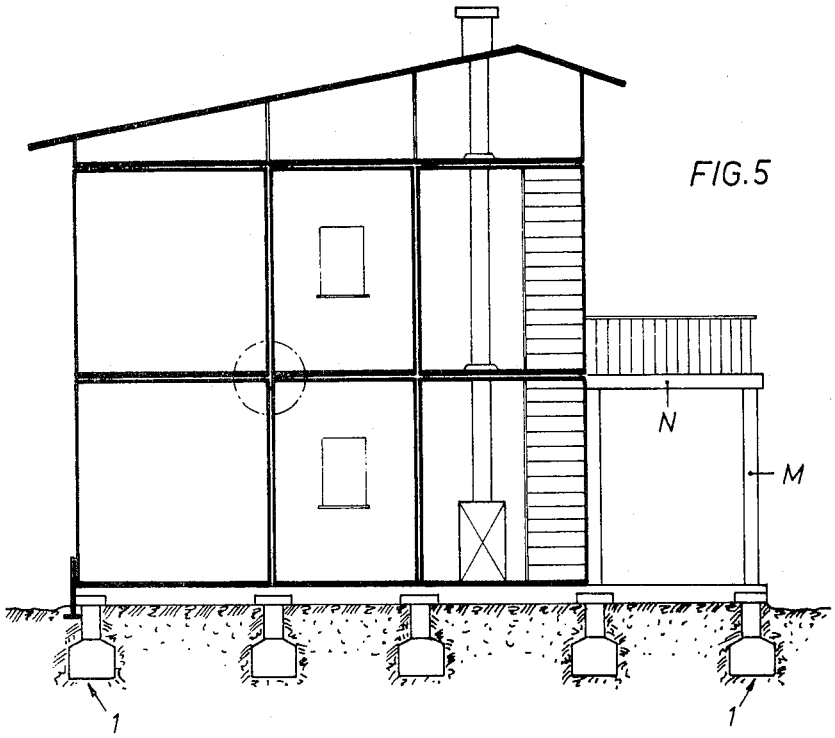
Figure 6:
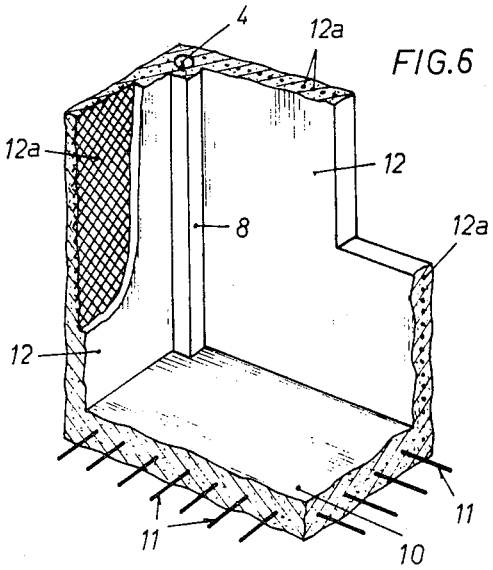
Figure 7:
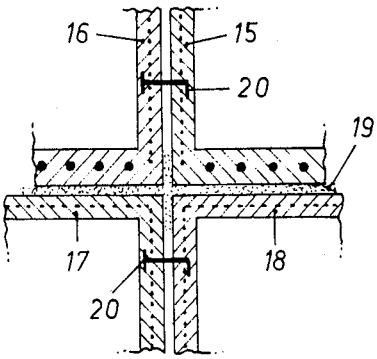

FIGS. 3, *3a*, *3b*, *3c*, show an axonometric view of the details of the beams, of the plinths and of the incorporated pillars, as well as a disposition of the same as to form the basement of the building;

FIG. 4, shows a perspective view of an already mounted part of the building of FIG. 1 with some parts in the mounting stage shown in an exploded axonometry;

FIG. 5, shows a perspective section view of a two-floor building realized with prefabricated elements according to the present invention;

FIG. 6, shows a detail of a prefabricated room according to the present invention, wherein the structure of the floor and of the walls is shown;

FIG. 7, shows an enlarged view of a detail of the hooking of the prefabricated elements indicated in the circle of FIG. 5;

FIGS. 8, 9, 10, show a top view of some kinds of prefabricated rooms according to the present invention;

FIG. 11, shows a perspective section view of a building of a plurality of floors out of prefabricated elements according to the present invention;

FIG. 12, shows an axonometric view of a detail, in enlarged scale, of the hooking of two prefabricated beams according to the present invention to the vertical pillar, by means of irons projecting in the apertures of the ends of the beams and out of the pillars;

FIG. 13, shows a section view, in enlarged scale, of a detail indicated in a circle in FIG. 11, of a hooking of a prefabricated room according to the present invention to the beams and to the pillar;

FIGS. 14, 15, 16, show an axonometric view of some self-supporting prefabricated panels according to the present invention.

FIGS. 1 and 2 show in a perspective and a section view, a one-floor building which is completely to be realized out of prefabricated elements according to the present invention, the stability of which is obtained only due to the own weight of the single elements. In FIG. *3a*, a prolongation 2 in the form of a quadrangular trunk of a plinth 1 according to the present invention, can be seen, whereby a part 3 of trunk, of a reduced section is provided, in which part 3 dead hole 4 is performed. Letter S shows the stop onto which one of the beams is resting. FIG. *3b* shows the end of one beam 5 according to the invention, provided with a quadrangular opening 6, of the same dimension of the part 3 of the trunk, and with irons 7 of the reinforcement thereof. FIG. *3c* shows a pillar 8, of reduced section, incorporated along the apex of the corner of two walls of a room (FIG. 6), with a joint prolongation 9 of the same section than the one of the dead hole 4 of part 3 of trunk of plinth 1. FIG. 3 shows the assembling of said elements as to form the basement framework of the building. Part *5a* in dotted lines shows that the beam resting between two plinths may also be longer that the room is. In this case the beam will show apertures 6 distanced in such a way as to receive the joints of the rooms also between one plinth and the other.

As can be seen in FIG. 4 the building to be realized consists, beyond the prefabricated walls forming the basement already described, also in room elements A, B, C, D, E, F, G, H. It can be seen how some of these elements have already been provided, in the construction stage thereof, with openings for doors, windows and the passage for the chimney and the access to the mansard; the joint projections and the dead holes of the pillars of reduced section incorporated in said elements can also be seen.

FIG. 5 shows a perspective view of a two-floor building which is to be realized by means of the prefabricated elements according to the present invention in the already described way. In this figure it can be seen how one of the prefabricated plinths 1 supports in a joint one of the prefabricated pillars M, in turn supporting a prefabricated floor of the terrace. The mounting of the terrace takes place like the mounting of the building. FIG. 6 shows a detail of the realization of the room or part of the room. Floor 10 can be seen realized with crossed irons 11 and walls 12 realized with a metallic network *12a* and concrete. Incorporated pillar 8 provided with dead hole 4 for the joint of the room or roof to be superposed can also be seen.

In FIG. 7 the resting system of rooms 15, 16 superposed onto lower rooms 17, 18 in an intermediate area of the building, where the incorporated pillars are not needed, i.e. where the stability is realized upon the resting of the superposed rooms, can be seen. The rooms can be simply resting one onto the other, but also a thin intermediate layer 19 of concrete can be provided. The walls can be hooked between each other by means of cramps 20, as can be seen in the drawing. It should be noted that, generally, all prefabricated elements can be realized also out of different materials, like e.g., wood, or mixed materials. The choice will take place case by case, still remaining within the concept of modular prefabrication of the elements.

FIGS. 8, 9, 10 show different kinds of rooms, whereby in the drawing the incorporated pillars as well as the openings for the hooking of the beams at the pillars, which is to be realized in loco so as to perform the casting. The room can also be realized, as shown in FIG. 9, with its own ceiling 21. The openings like doors, windows, arches etc., also provided in the designing stage, are realized in the prefabrication stage. The rooms can be whole or fractional rooms.

FIG. 11 in a perspective section view the design of a building with a plur lity of floors. The trunks 2, 2' of the plinths and the beams 5 forming the basement framework, as well as beams 5' connecting the pillars at every floor. The plinth carrying trunk 2' is greater than the plinth carrying trunk 2, as this plinth must support the weight of two adjacent rooms 22, 22' (as well as the weight of the superposed rooms), while between said rooms a free interspace 23 is provided which will serve for the reciprocal isolation. It can be seen how floor 10 of each room rests on beam 5, respectively 5'. Numeral 24 shows the irons which inirially are projecting from trunk 2 of the plinth, and which irons will be prolonged in height, after the hooking with irons 7 projecting out of beams 5, respectively 5', inside the relative apertures provided at the ends (FIG. 12). Around irons 24 forms for base of pillars 24' will be placed, and then concrete will be casted inside the same, after said irons 24 have been hooked to said irons 7 of the relative beams.

As can be seen in an enlarged detail of FIG. 13, the rooms show aligned apertures 26 in the floor and in the ceiling in correspondence of the joints of the beams as to allow the irons 24 to project of a determined section beyond the same and to allow, further, the hooking of the successive irons 24, as well as the concrete casting. Still in FIG. 13, numeral 6 shows the apertures provided at the ends of the beams for the hooking to the reinforced concrete pillar which is time by time casted. Numeral 11 shows the irons of the floor having the function of floor of the room.

FIGS. 14, 15, 16 show different embodiments of self-supporting panels 27, 28, 29 according to the present invention. On the vertical part 30, 30' of panels 27 and 28, and on base 31, respectively on plane 32 of panel 28, offsets 33, 33', respectively 34 for the reciprocal joint of the panels are provided. The panel 29 of FIG. 16 is provided without offsets.

The prefabricated elements according to the present invention have been hereinbefore described relating to some preferred embodiments of the invention. Obviously, said element can also be used for the realization of other works, separately or in combination, with different proportions, dimensions and dispositions, without therefore going out of the limits of the present invention.

What I claimed is:

1. A kit of constructional elements permitting the quick construction of a building, said elements comprising:

a plurality of plinths adapted to be located in an excavation at a building site to provide a foundation for a building, each of said plinths having (a) a base portion, (b) a first extension which is unitary with said base portion and has a first cross-section, and (c) a second extension which is unitary with said first extension and has a quadrangular cross-section, said quadrangular cross-section having an area which is less than the area of said first cross-section, bearing beams adapted to fit over said second extensions for support on said first extensions, each of said bearing beams having quadrangular apertures in each end thereof of substantially the same dimension as said quadrangular cross-section of the second extension, unitary prefabricated modules adapted to be positioned on said bearing beams, said modules including upper and lower substantially horizontal surfaces and vertical perimeter surfaces which interconnect said horizontal surfaces to define a hollow volume therein; and joint means on the ends of said second extensions for engaging said prefabricated modules when said prefabricated modules are positioned on said bearing beams.

2. A kit as claimed in claim 1 wherein said joint means on the ends of said second extensions are dead holes in the end surfaces, said prefabricated modules having spaced apart joint members which are dimensioned to fit into said dead holes.

3. Constructional elements permitting the quick construction of a building, said elements comprising:

a plurality of plinths, each having (a) a base portion, (b) an extension which is unitary with said base portion and has a first cross section, (c) a group of rods embedded in said plinth protruding upwardly from a central zone of said extension;

bearing beams adapted to rest on the upper surfaces of the first extensions of said plinths, each bearing beam having an aperture in each end thereof, each aperture having a size for receiving a group of said rods so that a group of said rods extends into each said aperture when the bearing beams rest on said first extensions, unitary modules including upper and lower substantially horizontal quadrangular surfaces and perimeter vertical surfaces which interconnect said horizontal surfaces to define a hollow volume therein, said lower horizontal surface having apertures which are spaced apart by distances which are equal to the spacing between said apertures of said beams, said modules being adapted to be positioned on said beams with the apertures of said beams substantially coincident with the apertures of said horizontal surfaces, said apertures of said modules and said apertures of said beams being adapted to receive a settable flowable composition to form load bearing pillars which extend downward through said apertures to said plinths.

4. A building structure comprising, a plurality of plinths each having (a) a base portion resting on a subsurface, (b) a first extension which is unitary with said base portion and has a first cross section, (c) a second extension which is unitary with said first extension and has a quadrangular cross-section, said quadrangular cross-section having an area which is less than the area of said first cross section, bearing beams resting on said first extensions and having apertures in each end thereof receiving said second extensions, unitary prefabricated modules resting on said beams and said second extensions, said modules including upper and lower substantially horizontal surfaces and perimeter vertical surfaces which interconnect said horizontal surfaces to define a hollow volume therein, and interfitting joint means for connecting said lower substantially horizintal surfaces of the modules with said second extensions of said plinths.

5. A building structure comprising a plurality of plinths each having (a) a base portion resting on a subsurface, (b) a first extension which is unitary with said base portion and has a first cross section (c) a group of rods embedded in said plinth and protruding upwardly from a central zone of said first extension, bearing beams supported on said first extension of the plinths, each of said bearing beams having an aperture in each end therof receiving a said group of rods, a unitary module including upper and lower substantilly horizontal quadrangular surfaces, and perimeter vertical surfaces which interconnect said horizontal surfaces to define a hollow volume therein, said lower surface having apertures therein, said module resting on said beams with the apertures of the beams being aligned with the apertures of said lower horizontal surface, and pillars extending from said upper surface of the module downward through said apertures to said plinths.

6. A construction method comprising the steps of excavating a plurality of holes in a site at predetermined distances apart;

placing prefabricated plinths in the excavated holes, each of said plinths having (a) a base portion, (b) a first extension which is unitary with said base portion and has a first cross-section, and (c) a second extension which is unitary with the first extension and has a second cross-section, said second cross-section having an area which is less than the cross sectional area of the first extension, placing bearing beams on said first extensions, said bearing beams having apertures in each end thereof of the same dimension as the second cross-section so that said second extensions occupy the apertures in the bearing beams, placing a unitary prefabricated module on said bearing beams, said module including upper and lower substantially horizontal surfaces and perimeter vertical surfaces which interconnect the horizontal surfaces to define a hollow volume therein, said module having joint means on said lower surface, and engaging the joint means with the second extensions of the plinths.

7. A construction method comprising the steps of excavating a plurality of holes in a site at predetermined distances apart;

placing prefabricated plinths in the excavated holes; each of said plinths having (a) a base portion, (b) a first extension which is unitary with said base portion and has a first cross-section, and (c) a group of rods embedded in the plinth and protruding upwardly from the upper surface of the first extension in an area which is less than the first cross-section;

placing bearing beams on said first extensions; said bearing beams having apertures in each end thereof in which each receive a said group of rods, said beams being placed to rest on the first extension so that a group of rods protrudes into each aperture;

placing a unitary prefabricated module on said bearing beams, said module including upper and lower substantially horizontal surfaces and perimeter vertical surfaces which interconnect the horizontal surfaces to define a hollow volume therein, the lower surface of said module having apertures therein, said modules being placed on the beams to align the apertures of the lower surface of the module with the apertures of the beams, and flowing a settable composition into the apertures and onto the upper surface of the first extension of the plinth, and permitting said composition to set to interconnect the module, the beam and the plinth.

8. A construction method as claimed in claim 7 wherein the bearing beams are provided with embedded rods which extend into the apertures of said bearing beams, and the step of placing the bearing beams on said first extensions is performed to hook the rods of the bearing beams over said rods which protrude upwardly from the first extension of the plinth.

9. A construction method as claimed in claim 8 wherein the module has apertures in the upper surface thereof, said group of rods being prolonged to extend beyond the height of the module, said step of flowing a settable composition being performed to form a pillar around the extended rods.

10. A construction method as claimed in claim 9 wherein the building is provided with an upper floor, including the steps of placing additional said beams over said pillars so that the prolonged rods pass through the apertures of the additional said beams, placing a second said module on the additional said beams so that the prolonged rods project through the apertures in the lower surface of the second module, and flowing a settable composition onto said pillar and into the apertures of said additional beams and second module to interconnect the pillar, the additional beams and the second module.

* * * * *